US005242657A

United States Patent [19]

Sahu

[11] Patent Number: 5,242,657

[45] Date of Patent: Sep. 7, 1993

[54] LEAD-FREE CORROSION RESISTANT COPPER-NICKEL ALLOY

[75] Inventor: Sudhari Sahu, Glendale, Wis.

[73] Assignee: Waukesha Foundry, Inc., Waukesha, Wis.

[21] Appl. No.: 907,816

[22] Filed: Jul. 2, 1992

[51] Int. Cl.[5] ..... C22F 1/00

[52] U.S. Cl. ..... 420/481; 420/485

[58] Field of Search ..... 420/481, 485

[56] References Cited

U.S. PATENT DOCUMENTS

| | | | |
|---|---|---|---|
| 2,849,310 | 8/1958 | Waller | 420/481 |
| 3,053,511 | 9/1962 | Godfrey | 420/485 |
| 4,012,240 | 3/1977 | Hinrichsen | 148/433 |
| 4,373,970 | 2/1983 | Scorey et al. | 148/433 |
| 4,822,567 | 4/1989 | Kato et al. | 420/442 |

FOREIGN PATENT DOCUMENTS

| | | | |
|---|---|---|---|
| 0042739 | 3/1983 | Japan | 420/481 |
| 0250721 | 4/1926 | United Kingdom | 420/481 |

*Primary Examiner*—Upendra Roy

*Attorney, Agent, or Firm*—Kinzer, Plyer, Dorn, McEachran & Jambor

[57] ABSTRACT

Lead-free copper-nickel corrosion resistant, low friction, castable alloy, particularly for food processing machine parts, with the following weight percent range Ni=15–45
Zn=2–6
Tin=2–7
Bi=1–6
Fe=0–3
Mn=0–3
Cu=balance and food processing machine parts made therefrom.

8 Claims, 3 Drawing Sheets

LEAD-FREE CORROSION RESISTANT COPPER-NICKEL ALLOY

BACKGROUND OF THE INVENTION

This invention relates to a corrosion resistant copper-nickel alloy particularly suited for use in dairy equipment and other food industries.

Copper-nickel alloys, popularly known as "Nickel Silvers" and "Dairy Metals" typically contain up to 5 weight percentage lead. For decades they have been used in contact with many dairy products, meat and poultry, juices, and other comestibles etc. During the past two decades it has been established that lead causes severe health problems in human beings even when present as only a few parts per billion in food. As a consequence, there is a concentrated effort to eliminate lead in metals that will be in contact with food. Lead was incorporated in dairy metals to give lubricating quality which reduces friction in metal to metal rubbing contact. Various foreign and domestic equipment certifying agencies have already declared that they will not accept any lead bearing materials in contact with food.

In the present invention a copper base alloy is disclosed which has all the desirable properties of dairy metals but contains no lead. The new alloy has acceptable mechanical properties, is readily cast, is easily machined and has good bearing qualities in that it moves freely upon itself or stainless steel without galling.

Prior approaches to materials for corrosion-wear-sanitary conditions have focused on nickel-base alloys of Thomas and Williams U.S. Pat. No. 2,743,176 and Larson U.S. Pat. No. 4,702,887. The present alloy is substantially less expensive compared to these nickel-base alloys. Additionally, the present alloy has the following features which are superior to nickel-base alloys.

1. Present alloy has better castability in the sense that it is less prone to micro-shrinkage than nickel-base alloys.
2. Present alloy is less prone to hot tearing than nickel-base alloys of U.S. Pat. Nos. 2,743,176 and 4,702,887. As a result complex shape parts may be cast out of present alloy, but they are not possible in alloys covered by the above patents. It is worth mentioning here that none of these alloys is amenable to weld repair.
3. Present alloy is less prone to hydrogen gas pick-up than nickel-base alloys. Hydrogen pick-up may result in gas porosity in cast parts.
4. Present alloy has much better machinability than nickel-base alloys.

SUMMARY OF THE INVENTION

The preferred analysis of my improved alloy is as follows:

| Element | Weight Percent |
|---|---|
| Copper | Balance |
| Nickel | 25.00 |
| Zinc | 4.00 |
| Tin | 5.00 |
| Bismuth | 4.00 |

Variation in the above chemistry is possible and a satisfactory alloy can have the following chemical ranges:

| Element | Weight Percent |
|---|---|
| Copper | Balance |
| Nickel | 15–45 |
| Zinc | 2–6 |
| Tin | 2–7 |
| Bismuth | 1–6 |
| Iron | 0–3 |
| Manganese | 0–3 |

This alloy may contain small amounts of C, Si, Al as incidental or trace elements.

When the ingredients are mixed in approximately the preferred analysis the following data will describe its physical properties:

| | |
|---|---|
| Tensile strength | 20,000–30,000 PSI |
| Yield strength | 18,000–28,000 PSI |
| Percent elongation in 2" | 0.5–3.0 |
| Brinell hardness | 100–140 |

DESCRIPTION OF THE PREFERRED EMBODIMENTS

Figure 1:
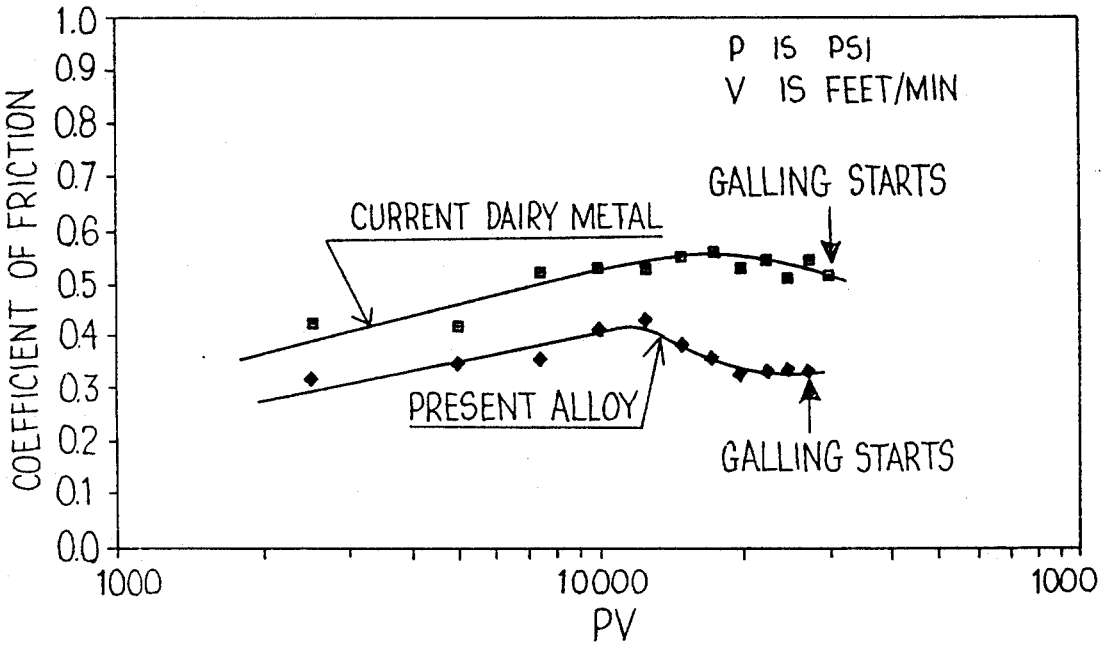
FIG. 1 is a plot of the co-efficient of friction versus product function PV which measures severity of loading.

In its methods aspects, the alloy can be melted in a gas fired crucible or an electric induction furnace. Zinc is charged at the bottom of the melting vessel followed by nickel and copper. When the charge is partially melted tin is added which melts readily. When the charge is completely molten, the slag on top of the melt is removed completely. Bismuth is added next to the melt and mixed as magnesium or lithium. The melt is tapped into a pouring vessel. The contents of the pouring vessel are then poured into mold to cast parts of desired shape and size. Following are chemical and mechanical properties of two heats made this way.

| | | | | |
|---|---|---|---|---|
| Heat #6164 | | | | |
| Cu = Balance | Ni = 28.50 | Zn = 4.20 | Sn = 5.95 | Bi = 3.28 |
| Tensile Strength = 21300 PSI | | Yield Strength = 21100 PSI | % Elongation = 2.5 | BHN = 129 |
| Heat #6434 | | | | |
| Cu = Balance | Ni = 25.44 | Zn = 4.38 | Sn = 5.88 | Bi = 3.87 |
| Tensile Strength = 21000 PSI | | Yield Strength = 20800 PSI | % Elongation = 1.5 | BHN = 116 |

Typical leaded dairy metal of similar composition has the following chemistry and mechanical properties.

| | | | | |
|---|---|---|---|---|
| Heat #6435 | | | | |
| Cu = Balance | Ni = 25.05 | Zn = 4.16 | Sn = 6.31 | Pb = 3.86 |
| Tensile Strength = 51700 PSI | | Yield Strength = 32700 PSI | | % Elongation = 7.5 BHN = 126 |
| Heat #6436 | | | | |
| Cu = Balance | Ni = 21.31 | Zn = 5.81 | Sn = 5.65 | Pb = 3.87 |
| Tensile Strength = 48800 PSI | | Yield Strength = 28600 PSI | | % Elongation = 11.5 BHN = 126 |

It is noted here that the present alloy has a lower level of strength and elongation. However, this type of alloy is not used for its tensile properties but for non-galling properties. Maximum design stress will seldom exceed 10,000 PSI.

The corrosion resistance of the alloy in contact with food and equipment cleaning solutions is very important. The alloy must have adequate corrosion resistance otherwise there will be product contamination due to corrosion product on one hand; on the other there will be difficulties in sanitizing and possible bacterial growth. Two common chemicals and three commercial cleaning and/or sanitizing compounds were selected to run the corrosion test. The list is given below:

1. Acetic acid solution in water (0.30 normal)
2. 10 weight percent of sodium hydroxide (NaOH) in water
3. Stera-Sheen: This a cleaning and sanitizing compound marketed by Purdy Products Co of Wauconda, Ill. Two ounces of powder Stera-Sheen were mixed in two gallons of water. This gives an active chlorine content of 100 parts per million.
4. Cloverleaf CLF450: This is a concentrated cleaning compound marketed by Cloverleaf Chemical Company of Kankakee, Ill. The cleaning solution was prepared by mixing two ounces of this cleaner with one gallon of water as recommended by the manufacturer. The solution has 250 parts per million of available chlorine.
5. Alumite 12: This is commercial cleaner marketed by Monarch Division of H. B. Fuller Company of Minneapolis, Minn. The test solution was prepared by dissolving two ounces of powder in one gallon of water giving 280 parts per million of available chlorine.

The corrosion test was run according to ASTM spec G31-72. The specimen was in the form of a circular disc with nominal OD=1.25", ID=0.375" and thickness=0.187". The specimen was properly prepared and its dimensions and weight were measured. The specimen was put inside a one liter solution of one of the above compounds. The solution was kept at 50 degrees C. and mildly agitated with a magnetic stirrer. The specimen was kept in the solution for 60 hours. At the end of this period, the specimen was taken out, washed thoroughly, dried and re-weighed. From the weight loss and dimensions of the specimen the corrosion rate in mils per year was calculated. Duplicate specimens were run for each condition and the reported corrosion rate is average of the two readings. The following table lists the details:

| | | Corrosion Rate in Mils Per Year | | | | |
|---|---|---|---|---|---|---|
| Alloy | Heat No. | Acetic Acid | NaOH | Sterasheen | Cloverleaf CLF-450 | Alumite 12 |
| Current | 6435 | 27.6 | 7.6 | 2.1 | 0.24 | 0.54 |
| Dairy Metal | 6436 | 29.2 | 7.1 | 3.6 | 0.27 | 0.60 |
| | Average | 28.4 | 7.3 | 2.8 | 0.25 | 0.59 |
| Present | 6164 | 26.3 | 0.5 | 0.8 | 0.09 | 0.13 |
| Alloy | 6434 | 26.3 | 1.0 | 1.2 | 0.03 | 0.09 |
| | Average | 26.3 | 0.7 | 1.0 | 0.06 | 0.11 |

An examination of this table makes it clear that the present alloy is far superior in corrosion resistance to the old "Dairy Metal".

The two metals are next compared for the value of coefficients of friction in rubbing contact. The test was run according to modified ASTM D3702 method. Rings of both metals were run against 316 stainless steel washers at room temperature in distilled water. Coefficient of friction values were measured for given PV values and are plotted in FIG. 1. Pressure P is measured in pounds per square inch and velocity V is measured in feet per minute. The product function PV is a measure of severity to which the specimen is subjected during a test. The higher the PV value the more severe the loading.

It can be seen from the graph that PV values needed for the start of galling are comparable for the two alloys. However, the coefficients of friction at any PV value for the present alloy is significantly lower than the current "Dairy Metal". This means that the new alloy will behave much more favorably in the rubbing contact against other metals.

Figure 2:
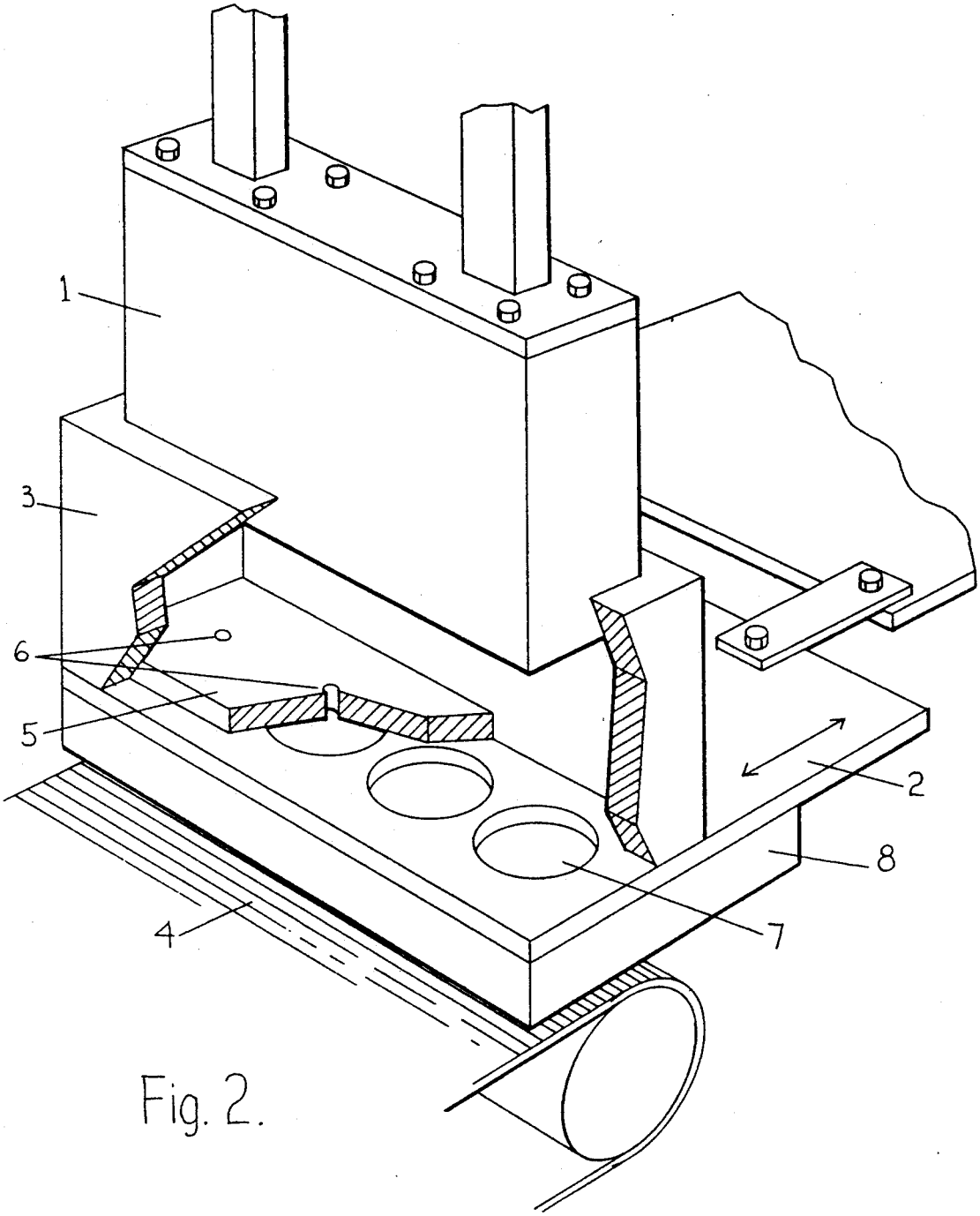
FIGS. 2 and 3 show examples of equipment in which parts made with the alloy of this invention are embodied.
Figure 3:
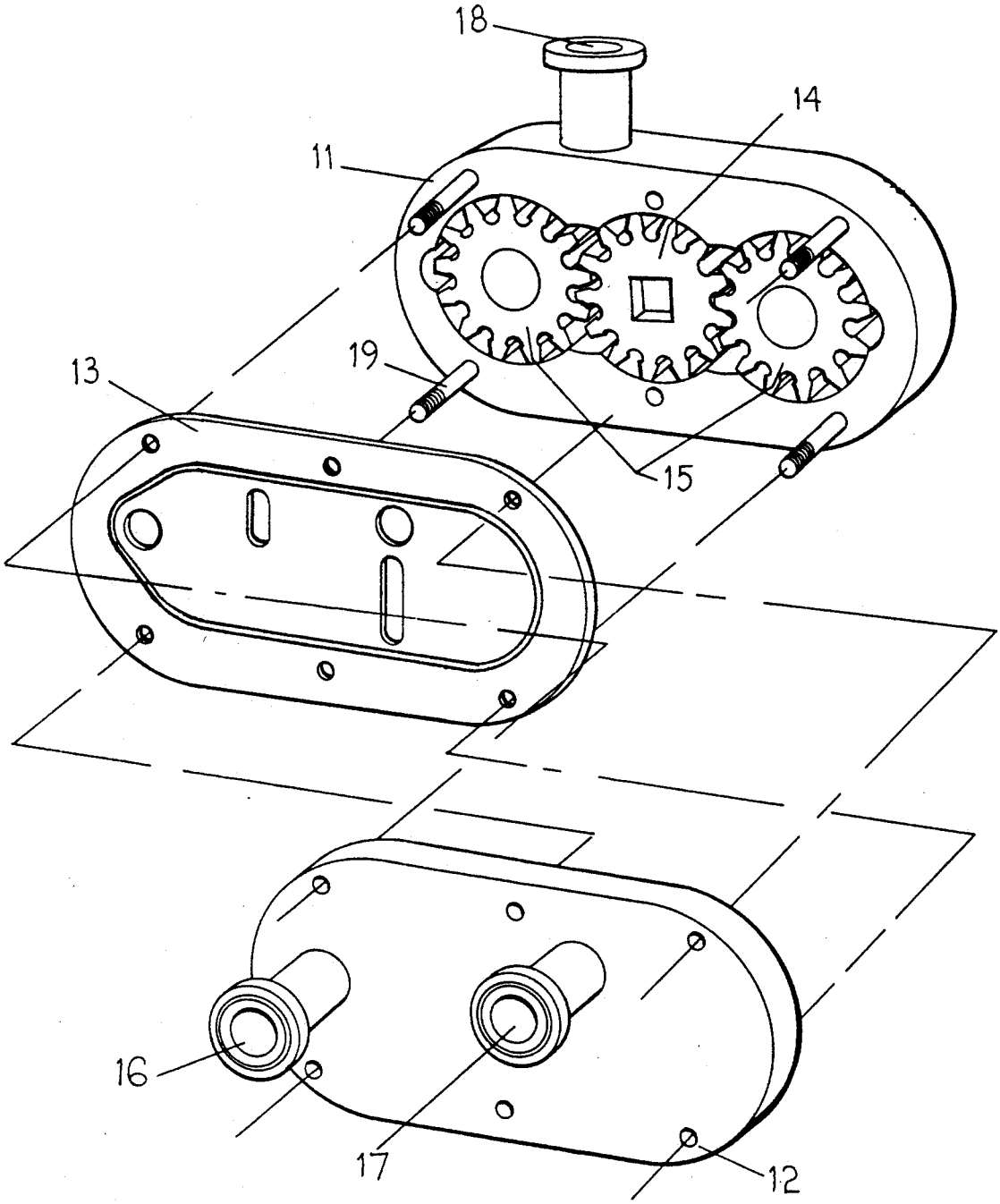

Two examples of typical equipment in which the present alloy may be embodied are shown in FIGS. 2 and 3. FIG. 2 depicts part of a food forming machine. Chamber 3, base plate 5 and plate support 8 may be standard cast or wrought stainless steel. Plunger 1 and plate 2 (in contact with food) may be made from the present alloy. The opposed members as 3 and 5 can also be made of the present alloy, as well as other parts in contact with food. In operation, the food product charged into the valve chamber 3 is pushed under pressure by plunger 1 into die cavities 7 through inlet openings 6 in the base plate 5. The plunger then retracts. The plate is pushed forward (to the left, FIG. 2) and portions are knocked out onto the conveyor 4. The plate then moves back into the original position and the whole process repeats again.

FIG. 3 depicts a product/air mix pump for an ice cream machine. Pump body 11, pump cover 12, gasket 13 and studs 19 may be machined out of stainless steel either cast or wrought. Drive gear 14 and pump gears 15 may be made out of present alloy. Other parts in contact with food products can be made of the present alloy. In operation, mix and air are metered into inlet 16 and 17 respectively and the ice cream comes out of outlet 18 in a smooth, fine textured form.

I claim:

1. In a food processing machine in which opposed members are in contact with one another, at least one of said members being fabricated of an alloy constituting the following in percentage by weight, Ni=25, Zn=4, Sn=5, Bi=4 and balance essentially Cu.

2. The food processing machine according to claim 1 in which one of the opposed members is made of stainless steel.

3. In the food processing machine according to claim 1 in which the opposed members in contact with each other are a plunger and a die member.

4. In the food processing maching according to claim 1 in which said opposed members in contact with each other are a drive gear and a pump gear and each gear is fabricated of said alloy.

5. In a food processing machine in which opposed members are in contact with one another, at least one of said members being fabricated of an alloy constituting the following in weight percentage range:

Ni=15–45
Zn=2–6
Tin=2–7
Bi=1–6
Fe=0–3
Mn=0–3
Cu=Balance.

6. In the food processing machine according to claim 5 in which one of the opposed members is made of stainless steel.

7. In the food processing machine according to claim 5 wherein the opposed members are a plunger member and a die member and each member is fabricated of said alloy.

8. In the food processing machine according to claim 5 in which said opposing members are a drive gear and a pump gear and wherein each gear is fabricated of said alloy.

* * * * *